United States Patent [19]

Kolb

[11] Patent Number: 4,821,362

[45] Date of Patent: Apr. 18, 1989

[54] SPLATTER SHIELD FOR CONVENTIONAL PAINT ROLLER

[76] Inventor: Kenneth W. Kolb, 3611 Airline Hwy., Metairie, La. 70001

[21] Appl. No.: 10,970

[22] Filed: Feb. 5, 1987

Related U.S. Application Data

[63] Continuation-in-part of Ser. No. 724,260, Apr. 17, 1985, abandoned.

[51] Int. Cl.[4] ..... B05C 17/02; B44D 3/28

[52] U.S. Cl. ..... 15/248 A; 401/15; 401/197

[58] Field of Search ..... 220/91; 15/248 A; 401/15, 197, 138, 193; 362/359, 282, 413

[56] References Cited

U.S. PATENT DOCUMENTS

| | | | |
|---|---|---|---|
| 600,557 | 3/1898 | Simpson | 401/278 |
| 2,612,336 | 9/1952 | Tuttle | 248/359 |
| 2,763,022 | 9/1956 | Glacken | 15/248 |
| 2,902,706 | 9/1959 | Gaetke | 15/248 |
| 3,115,659 | 12/1963 | Church | 15/248 A |
| 3,274,637 | 9/1966 | Schulze | 401/15 |
| 3,378,872 | 4/1968 | Frontera | 15/230 |
| 3,457,582 | 7/1969 | Fisher | 15/248 |
| 3,748,683 | 7/1973 | Smith et al. | 15/248 |
| 3,825,970 | 7/1974 | Hanssen | 15/230 |
| 3,942,209 | 3/1976 | Walls | 15/118 |
| 4,011,622 | 3/1977 | Gillum et al. | 15/248 |
| 4,063,325 | 12/1977 | Lizak | 15/230 |
| 4,254,529 | 3/1981 | Cooke | 15/230 |

FOREIGN PATENT DOCUMENTS

| | | | |
|---|---|---|---|
| 582707 | 9/1959 | Canada | 15/248 A |
| 1124690 | 10/1956 | France | 220/91 |

*Primary Examiner*—Richard J. Apley
*Assistant Examiner*—Franklin L. Gubernick
*Attorney, Agent, or Firm*—Robert C. Tucker; William D. Kiesel; Timothy J. Monahan

[57] ABSTRACT

A splatter shield is provided for a conventional paint roller having an offset roller arm integrally connected to a roller shaft, comprising an inner end wall; an outer end wall; and two side walls, all connected so as to have substantially parallel lower edges which define a first plane; a top wall connected to the upper edges of the end walls and side walls so as to define a second plane substantially parallel to the first plane, the inner end wall having an opening therein, the opening communicating with the lower edge of the inner end wall by a cut between the opening and the lower edge of the inner wall, the outer end wall having an aperture for receiving the end of the roller shaft; and an annular shoulder member, fixedly attached to the inner end wall and concentric with the opening, the shoulder member having a plurality of raised ridges, radially spaced about the shoulder member, forming corresponding indentations approximately equal in width to the diameter of the roller arm.

4 Claims, 3 Drawing Sheets

SPLATTER SHIELD FOR CONVENTIONAL PAINT ROLLER

This is a continuation-in-part of application Ser. No. 724,260, filed on Apr. 17, 1985, now abandoned.

BACKGROUND OF THE INVENTION

1. Field of Invention

The present invention relates to an improved paint roller splatter shield. In particular, the present invention relates to an improved paint roller splatter shield which is easily adjusted.

2. Description of Prior Art

Paint shields of various construction and arrangement have heretofore been provided for attachment to a paint roller to protect the user and proximate surfaces from the spray of paint which accompanies the use of the roller. The prior devices generally are of expensive and complicated construction and are not arranged for convenient attachment to and removal from the paint roller. Further, such devices generally are not mounted for relatively free rotation about the roller, thereby to facilitate application of paint to the roller and to permit the use of the roller in reverse direction or on the ceiling.

The following list of patents discloses design features which have been conceived previously:

| U.S. Pat. No. | Patentees | Issue Date |
|---|---|---|
| 4,254,529 | Cooke | 1979 |
| 4,063,325 | Lizak | 1977 |
| 3,825,970 | Hanssen | 1974 |
| 3,748,683 | Smith | 1973 |
| 3,457,582 | Fisher | 1969 |
| 3,378,872 | Frontera | 1968 |

Frontera discloses a paint shield wherein the paint shield is frictionally attached to the paint roller and is held in place by a fastener which extends through a coupling device, which is coupled to the end of the paint roller, and through a slot in the side of the paint shield. This design does not allow for rollers which do not have the roller shaft protruding out of the end cap. The design also requires multiple parts which would make it costly to produce.

Although Fisher discloses a splatter shield which is adjustable, it has two drawbacks. One, it does not allow for shielding of paint splatter from the ends of the paint roller, and secondly, it is not adaptable to all conventional paint rollers. Fisher also requires a multiplicity of parts.

Smith discloses a paint shield which attaches only by frictional forces on the roller shaft. Although this allows for a greater range of rotation and easier adjustment, the frictional forces do not sufficiently hold the shield stationary after repeated rotation of shield. Nor does Smith allow for rollers which do not have the roller shaft protruding out of the end cap.

Hanssen discloses a paint roller with a spray shield incorporated into the frame. This arrangement is more expensive to produce and does not allow for attachment to conventional rollers.

Lizak discloses a shield supported by rods rotatably secured to a stub-shaft which is fixed to the handle. This shield design also has multiple parts causing it to be time consuming to assemble and costly to produce.

Cooke discloses a paint roller with spray shield incorporated into frame. This apparatus does not allow for adjustment of the shield relative to the handle, is more expensive to produce and is not adaptable to all conventional rollers.

While some of the above listed patents provide some shielding from paint splatter, none of the above patents provide a shield which contains all of the following characteristics: simplistic design, inexpensive to produce, allows 360° rotation around the roller independent of the roller handle, allows for attachment to the roller when the roller shaft protrudes through the end cap, easily adjustable, will remain stationary with respect to the handle after adjustment, and is made of a highly flexible, durable and easily cleaned material.

It is probably because of the shortcomings of these shield designs that such shields are not to be found on the market.

SUMMARY OF THE INVENTION

Therefore, it is a primary objective of the present invention to provide a paint splatter shield for a paint roller having an offset handle and which is easily adjustable so that the roller might be used either on walls or on ceilings.

It is yet a further objective of the invention to provide a splatter shield which is not only inexpensive to manufacture, but quite simple to attach and to use.

It is yet a further objective of this invention to provide an improved shield for a paint roller, in which the shield is quickly and conveniently attachable and removable from the roller.

Another objective of this invention is to provide a shield constructed and arranged to be snapped into operative position on a conventional paint roller having an offset handle.

It is yet a further objective of this invention to produce a shield having means for attachment thereof to a conventional paint roller having an offset handle, and which carries a means for mechanical coupling with the handle, thereby to retain the shield in a set position relative to the roller handle while affording ease of adjustability.

Yet another objective of this invention is to produce a shield which is lightweight and easily cleaned, preferably made of polypropylene.

Accordingly, a splatter shield is provided for a conventional paint roller having an offset roller arm integrally connected to a roller shaft, comprising an inner end wall; an outer end wall; and two side walls, all connected so as to have substantially parallel lower edges which define a first plane; a top wall connected to the upper edges of the end walls and side walls so as to define a second plane substantially parallel to the first plane, the inner end wall having an opening therein, the opening communicating with the lower edge of the inner end wall by means of a cut between the opening and the lower edge of the inner wall, the outer end wall having an aperture for receiving the end of the roller shaft; and an annular shoulder member, fixedly attached to the inner end wall and concentric with the opening, the shoulder member having a plurality of raised ridges, radially spaced about the shoulder member, forming corresponding identations approximately equal in width to the diameter of the roller arm.

The above and other objectives and advantages of the invention will become apparent from the following description when considered with the accompanying drawings.

DESCRIPTION OF THE PREFERRED EMBODIMENTS

Figure 3:
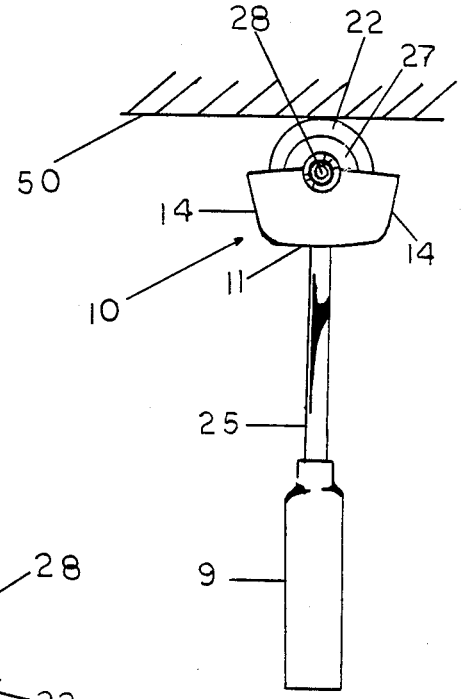
FIG. 3 is a side view of the invention showing the roller and shield arranged for applying paint to a ceiling.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternatives and further modifications in the illustrated device, and such further applications of the principles of the invention as illustrated therein being contemplated as would normally occur to one skilled in the art to which the invention relates.

Figure 7:
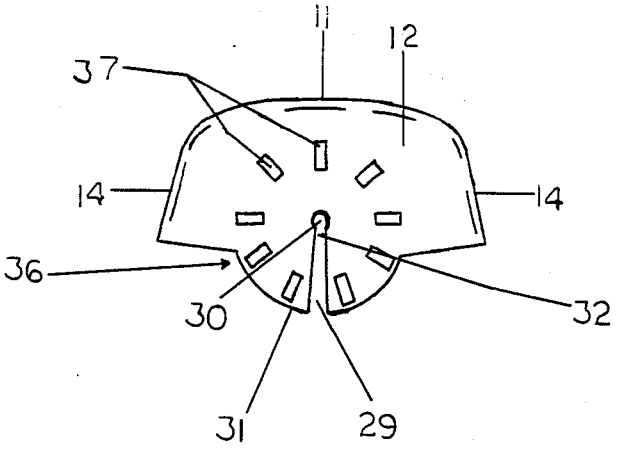
FIG. 7 is a side view showing the inner end wall and coupling mechanism of a preferred embodiment of the invention.

The paint shield 10 generally comprises a top wall 11, an inner end wall 12, an outer end wall 13, and side walls 14. The top wall 11 and side walls 14 together prevent paint from being sprayed from the roller pad 22. The end walls 12, 13 cooperate with top wall 11 and sidewalls 14 to form a basin for receiving paint which has been sprayed or dripped from roller pad 22. Roller pad 22 is rotatably attached in a conventional manner to roller shaft 24, which is in turn integrally attached to offset roller arm 25. Roller shaft 24 either terminates inside roller end cap 23 or protrudes slightly through end cap 23 as shown in U.S. Pat. No. 3,748,683 (FIG. 3) and U.S. Pat. No. 3,378,872 (FIG. 7).

The shield 10 is provided with an end portion 20, frictionally insertable between the roller pad 22 and roller end cap 23, which is in turn rotatably attachable to the roller shaft 24. The end portion 20 is frictionally wedged between the roller pad 22 and roller end cap 23 by a plurality of slender friction tabs 21. The end portion 20 is provided with a base plate 27 attached to projection hub 28 which rotatably engages the aperture 26 in the outer end wall 13. Unlike the prior art devices, however, the present invention is rotatably securable to a conventional roller, which may or may not have the roller shaft 24 protruding through the end cap 23. With the end portion 20 molded from polypropylene or other resilient material, the rotatably attached paint shield 10 may be released from its rotatably engaged position by bending the flexible outer end wall 13 and disengaging the projection hub 28 from the aperture 26.

The inner end wall 12 is provided with resiliently expandable opening 30 which communicates with lower edge 31 of the inner end wall 12 by means of a wedge-shaped cut 32. The cut 32 intersects the opening 30 to provide a restriction having a dimension less than the diameter of the opening 30, such that shaft 24 will snap into place. The inner end wall 12 is provided with an annular shoulder section 36, concentric with opening 30, and having a slot 29 therein, aligned and communicating with cut 32. The shoulder section 36 is preferably molded integrally with the inner wall 12 such that shoulder section 36 frictionally couples to the roller arm 25. The shoulder section 35 further comprises several raised ridges 34 or adjustment tabs 37 (see FIG. 7) radially spaced about its perimeter, forming corresponding indentations 33 approximately equal in width to the diameter of the roller arm 25. Ridges 24 or tabs 37 are of sufficient height to prevent undesirable free movement of the shield 10 about roller shaft 24, but are low enough to enable ease of movement for adjustment of shield 10 by forcing roller arm 25 across ridges 24 or tabs 37. Tabs 37 should be flexible enough to allow them to bend such that roller arm 25 may snap across tabs 37 for adjustment. The shield 10 and shoulder section 33 are preferably molded as a one piece unit from a resilient material, such as a synthetic polymer, preferably polypropylene, in order to allow repeated adjustment as described above.

The shield 10 covers approximately fifty percent of the outer surface of the paint roller to prevent paint splatter, and may be rotated 360° about roller pad 22.

Figure 2:
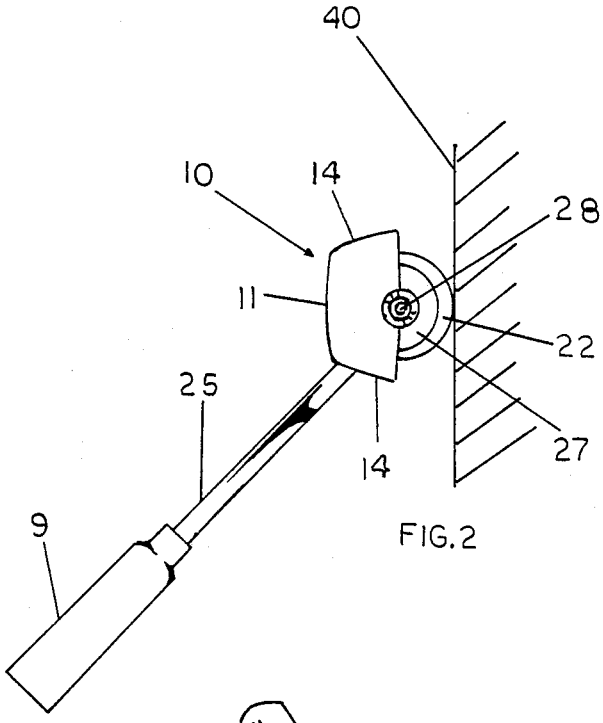
FIG. 2 is a side view illustrating a roller and splatter shield in accordance with the invention arranged for applying paint to a wall.
Figure 1:
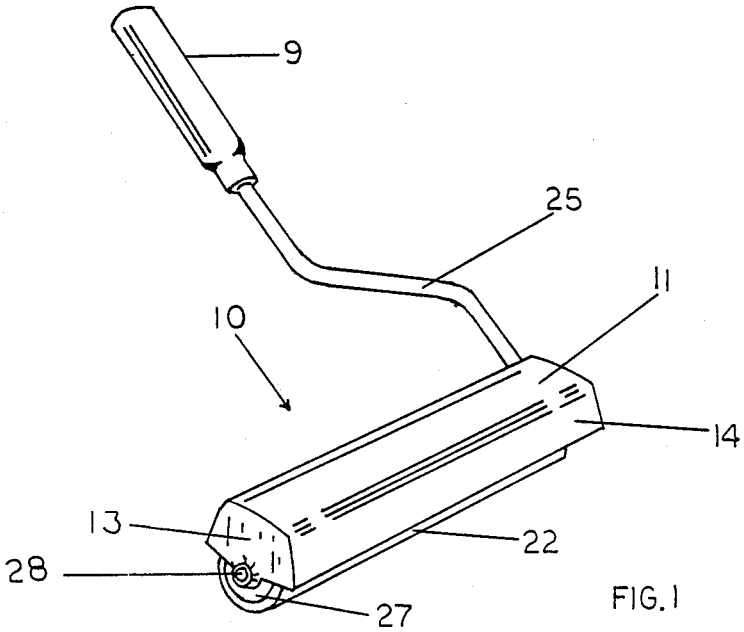
FIG. 1 is a perspective view of the invention in position on a conventional paint roller.
Figure 4:
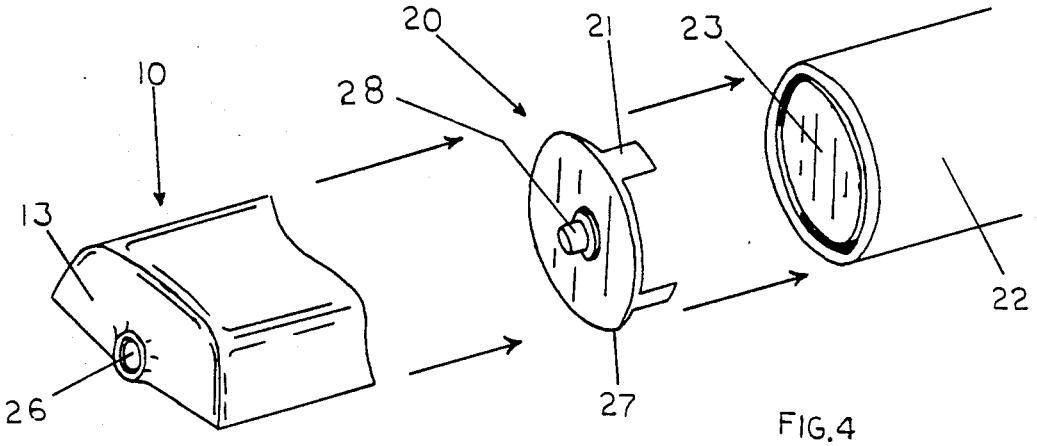
FIG. 4 is a partial perspective view of the outer end wall of the invention in exploded disposition with relation to the end portion of the invention, the roller end cap and the roller pad.
Figure 5:
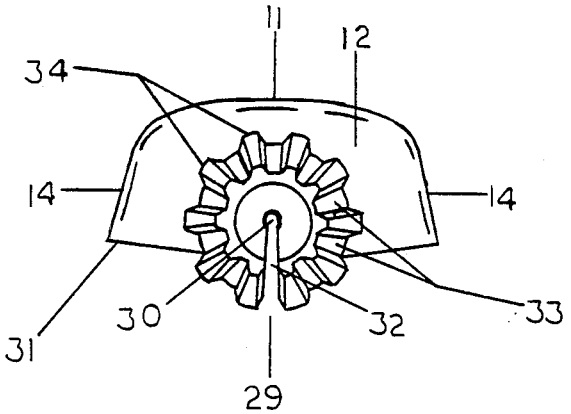
FIG. 5 is a side view showing the inner end wall and coupling mechanism of the invention.
Figure 6:
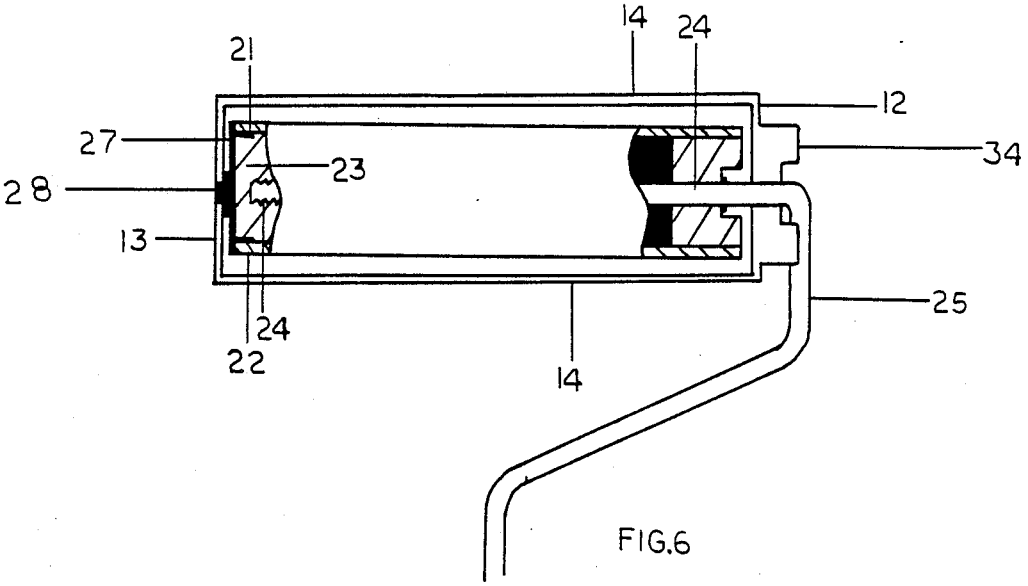
FIG. 6 is a top view of the invention attached to a paint roller, parts of the roller being shown in section.

It is thus apparent that the position of the paint shield 10 may be located as shown in FIG. 3 whereby the roller pad 22 is arranged to apply paint to a ceiling 50. By simply twisting the paint shield 10 about the shaft 24, the relative position of the shield 10 and the handle 9 may be changed to that as showing in FIG. 2 whereby the roller is positioned to apply paint to a wall 40.

While the above embodiments of the invention have been defined in specific terms, it will be obvious to those skilled in the art that variation may be made without departing from the spirit and scope of the invention, as defined by the following claims.

I claim:

1. A splatter shield for a conventional paint roller having a roller arm integrally connected to a roller shaft, comprising an inner end wall; an outer end wall; and two side walls, all connected so as to have substantially parallel lower edges which define a first plane; a top wall connected to the upper edges of said end walls and side walls so as to define a second plane substantially parallel to said first plane, said inner end wall having an opening therein, said opening communicating with the lower edge of said inner end wall by means of a cut between said opening and said lower edge of said inner wall, said cut intersecting said opening to form a restriction having a width less than the diameter of said opening, said outer end wall having an aperture alignable with a roller shaft; and an annular shoulder member, integrally formed with said inner end wall and concentric with said opening, said shoulder member having a slot, communicating with said cut, and a plurality of resilient raised ridges, radially spaced about said shoulder member, forming corresponding indentations approximately equal in width to the diameter of a roller arm, said ridges extending to a height so as to prevent free radial movement of said shield when said shield is in place on a roller shaft, allowing forced radial adjustment of a roller arm about said opening such that any adjacent pair of said ridges will bracket a roller arm and whereby the shield can be attached to the roller arm by sliding a portion of said arm through the slot and cut and into the opening where it is maintained in position by the said restriction at the point where the slot meets the opening.

2. A splatter shield for a conventional paint roller having a roller arm integrally connected to a roller shaft as described in claim 1, further comprising an end portion comprising a circular base plate, a projection hub extending axially outward from the center of said base plate, said hub being matingly insertable in said aperture, and a plurality of friction tabs extending axially inward from the perimeter of said base plate such that said tabs are insertable between a roller pad and a roller end cap of a paint roller.

3. A splatter shield for a conventional paint roller having a roller arm integrally connected to a roller shaft, comprising an inner end wall; an outer end wall; and two side walls, all connected so as to have substantially parallel lower edges which define a first plane; a top wall connected to the upper edges of said end walls and side walls so as to define a second plane substantially parallel to said first plane, said inner end wall having an opening therein, said opening communicating with the lower edge of said inner end wall by means of a cut between said opening and said lower edge of said inner wall, said cut intersecting said opening to form a restriction having a width less than the diameter of said opening, said outer end wall having an aperture alignable with an offset roller shaft; and an annular shoulder member, integrally formed with said inner end wall and concentric with said opening, said shoulder member having a slot, communicating with said cut, and a plurality of flexible adjustment tabs, radially spaced about said shoulder member, the space between any two said adjustment tabs being approximately equal to the diameter of a roller arm, said adjustment tabs extending to a height so as to prevent free radial movement of said shield when said shield is in place on a roller shaft, allowing forced radial adjustment of a roller arm about said opening such that any adjacent pair of said tabs will bracket a roller arm and whereby the shield can be attached to the roller arm by sliding a portion of said arm through the slot and cut and into the opening where it is maintained in position by the said restriction at the point where the slot meets the opening.

4. A splatter shield for a conventional paint roller having an offset roller arm integrally connected to a roller shaft as described in claim 3, further comprising an end portion comprising a circular base plate, a projection hub extending axially outward from the center of said base plate, said hub being matingly insertable in said aperture, and a plurality of friction tabs extending axially inward from the perimeter of said base plate such that said tabs are insertable between a roller pad and a roller end cap of a paint roller.

* * * * *